US008978831B2

(12) United States Patent
Shilpiekandula et al.

(10) Patent No.: US 8,978,831 B2
(45) Date of Patent: Mar. 17, 2015

(54) CABLING CONFIGURATION FOR RAILLESS ELEVATORS

(75) Inventors: Vijay Shilpiekandula, Boston, MA (US); William Yerazunis, Acton, MA (US); John C. Barnwell, III, Leominster, MA (US); Scott A. Bortoff, Brookline, MA (US); Joseph Katz, Stony Brook, NY (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 416 days.

(21) Appl. No.: 13/298,467

(22) Filed: Nov. 17, 2011

(65) Prior Publication Data

US 2013/0126275 A1 May 23, 2013

(51) Int. Cl.

| | |
|---|---|
| ***B66B 11/08*** | (2006.01) |
| ***B66B 7/02*** | (2006.01) |
| ***B66C 13/06*** | (2006.01) |
| ***B66B 11/00*** | (2006.01) |
| ***B66B 7/06*** | (2006.01) |
| ***B66B 11/02*** | (2006.01) |

(52) U.S. Cl.

CPC ..... *B66B 11/008* (2013.01); *B66B 7/06* (2013.01); *B66B 11/02* (2013.01)

USPC ..... 187/254; 187/407; 212/273

(58) Field of Classification Search

CPC B66B 11/0065; B66B 11/007; B66B 11/008; B66B 7/10; B66C 13/06

USPC ..... 187/254, 404, 407, 411, 412; 212/273, 212/274

See application file for complete search history.

(56) References Cited

U.S. PATENT DOCUMENTS

| | | | | | |
|---|---|---|---|---|---|
| 12,640 | A * | 4/1855 | Murtaugh | 187/251 |
| 353,458 | A * | 11/1886 | Murtaugh | 187/249 |
| 1,132,769 | A * | 3/1915 | Gale | 187/264 |
| 1,376,253 | A * | 4/1921 | Clark | 187/407 |
| 2,861,449 | A * | 11/1958 | Cohan | 73/12.01 |
| 3,081,884 | A * | 3/1963 | Minty | 212/274 |
| 3,202,243 | A | 8/1965 | Seward | |
| 3,276,602 | A * | 10/1966 | Vogeley et al. | 212/274 |
| 3,532,324 | A * | 10/1970 | Crittenden | 254/285 |
| 3,565,217 | A * | 2/1971 | St. Louis | 187/256 |
| 3,828,940 | A * | 8/1974 | Cooper | 212/308 |
| 3,945,504 | A * | 3/1976 | Wright | 212/274 |
| 4,544,070 | A * | 10/1985 | Sickler | 212/273 |
| 5,526,901 | A * | 6/1996 | Salmon | 187/249 |
| 6,644,486 | B2 * | 11/2003 | Jacoff et al. | 212/274 |
| 6,860,367 | B1 * | 3/2005 | Ericson | 187/265 |
| 7,150,367 | B2 * | 12/2006 | Dehm et al. | 212/274 |
| 7,296,661 | B1 * | 11/2007 | Petricio Yaksic | 187/266 |

(Continued)

FOREIGN PATENT DOCUMENTS

| | | |
|---|---|---|
| JP | 6064863 | 3/1994 |
| JP | 2002326778 A1 | 11/2002 |
| JP | 2010215391 A1 | 9/2010 |

*Primary Examiner* — William E Dondero
*Assistant Examiner* — Minh Truong
(74) *Attorney, Agent, or Firm* — Dirk Brinkman; Gene Vinokur

(57) ABSTRACT

An elevator including a car is arranged in a shaft. A set of compensator cables are attached to a bottom of the car and engaged with a compensator drum. A set of hoist cables are attached to a top of the car and engaged with a hoist drum to move the car vertically in the shaft, wherein the set of compensator cables and the set of hoist cables are configured to only move the car vertically.

11 Claims, 8 Drawing Sheets

(56) References Cited

U.S. PATENT DOCUMENTS 7,878,306 B2 * 2/2011 Siewert et al. ..... 187/264
2003/0019828 A1 * 1/2003 Choi et al. ..... 212/274
2007/0227825 A1 * 10/2007 Siewert et al. ..... 187/250
2009/0066100 A1 * 3/2009 Bosscher et al. ..... 294/86.4

* cited by examiner

CABLING CONFIGURATION FOR RAILLESS ELEVATORS

FIELD OF THE INVENTION

This method applies generally to vertical transportation systems, and particularly to elevators and other vertical transportation and material handling systems.

BACKGROUND OF THE INVENTION

Vertical transportation systems have numerous uses. Specifically, elevators are widely used for vertical transportation of people, materials, and other commodities. The applications of elevators include, but are not limited to, transportation in commercial and residential buildings, wind mills, mines, cruise ships, and also for material handling in shipyards, medical centers, and industrial facilities.

The prime requirements for elevators are safety and comfort. Conventional elevators use rail guides to provide vertical guidance and emergency safety stops. A set of drive cables from a traction motor are used to vertically move the elevator along the rail guides. Many safety systems have been developed for rail guides to enable mechanical locking in case of power breakdowns, or cable failure. However, rail guides increase the cost of installation, maintenance and severely compromise ride comfort.

FIGS. 1A-1B show a front view 100 and a side view 170 of a conventional elevator, respectively. The front view shows an elevator car 110 configured to move in a shaft along rail guides 150. Rollers 190 engage with the rail guides.

The car is hoisted in the shaft with hoist cables 120 wound around a hoist drum 130, which is driven by a traction motor 140. Compensator cables 125 are available with a compensator drum 160, which is not actuated. A counter weight 180 is provided on the rear side of the shaft.

As can be seen in FIG. 1, the cables in conventional elevators run parallel to the direction of up/down movement. This makes it difficult to provide lateral stability without the guide rails. In addition, as can be seen in a top view 171, the cables are generally attached to the top and bottom centers 175 of the car.

Typical elevator installation costs include shaft preparation and elevator component installation. A major cost involved in the process is for installing rail guides. Rail guides are available as short segments of steel that are bolted to a steel frame installed in the shaft of the elevator. At the joints of the rail guide segments, often, small (on the order of 1-2 cm) bumps are formed that hinder the ride quality, especially, resulting in large lateral accelerations, tilting and turning of the elevator. Such parasitic motions of the elevator result in poor ride comfort for the passengers. Precise alignment makes rail guides expensive to install, and further, alignment degrades over time causing lateral vibration, and increasing the associated maintenance costs.

Both first-time installation and post-installation rectification for degraded alignment are labor-intensive processes that require the whole elevator car and other cars in the shaft to be shut down for checking the rail guide alignments at each joint. In a twenty floor building, this may take months. Even after precise alignment, improving ride quality necessitates additional accessories such as one or more roller suspension assemblies and associated electronics and control systems to compensate challenges imposed by the rail guides.

In summary, rail guides pose installation, maintenance, and ride-quality challenges that severely undermine their cost-effectiveness.

Accordingly, there is a need to address disadvantages of rail guides in elevators.

SUMMARY OF THE INVENTION

It is an object of the invention to eliminate the need for rail guides in elevators.

It is a further object of the invention to vertically guide the elevator car while still achieving a desired ride quality and safety performance requirements for elevators.

It is a further object of the invention to minimize the cost of raw material, installation, and maintenance of elevators.

The embodiments of the invention are based on a motivation of constructing elevators without the rail guides. This is a challenging problem because without the rail guides both vertical guidance and safety performance can be severely compromised.

An elevator car suspended from drive cables alone, without rail guides to support the vertical motion of the car, can have high lateral accelerations from resonances of the suspended car being excited by external disturbances such as air pressure changes in the elevator shaft, machine room displacements caused by earthquake and wind disturbances.

In one embodiment of the invention, a set of cables is used to enable vertical guidance and safety design for the elevator car. Multiple cable configurations are provided to facilitate vertical guidance while at the same time imparting the required rigidity in the other dimensions, i.e., lateral (fore and aft, left and right), tilting (pitch/roll), and turning (yaw) for minimizing parasitic motions in those directions for the elevator. In other words, it is an intent to limit the degrees of freedom in which the car can move to only a single degree, i.e., vertical motion.

By minimizing parasitic motions in other dimensions, the elevator ride-quality performance is enhanced and less lateral accelerations are perceived by the passengers.

Moreover, the cabling configuration is designed such that resonances of the car are moved to frequencies much higher than the operational frequencies, and minimal parasitic motions are caused by external disturbances such as air pressure changes in the elevator shaft, machine room displacements caused by earthquake and wind disturbances.

Multiple safety designs are incorporated in the embodiment of the invention. First, a set of pre-tensioned safety cables can be provided for the elevator car to engage with in case of emergencies resulting from a sudden failure of the traction motor-drive cable system. The safety cables can be anchored at multiple locations in the elevator shaft to enhance a lateral rigidity. One or more extended brake shoes attached to the elevator car can achieve distributed braking over multiple redundant safety cables on each side. The use of redundant safety cables distributes the braking load among multiple cables, thereby reducing the chances of safety cable failure.

The set of cables described above for vertical guidance can be implemented by rearranging the drive cables, without the need for extra cabling. This option is highly desirable for reducing the cost of raw material, i.e. cabling and rail guides, required for conventional elevators.

In another embodiment of the invention, the cabling configuration is altered to result in a simpler pulley arrangement, and fewer pulleys and cables. In stead of crisscross of the hoist and compensator cables both on top and bottom of the car, the crisscross is provided in orthogonal planes to reduce the number of cables and pulley required, while still maintaining the required lateral rigidity.

In yet another embodiment, different cabling configurations are achieved by crisscrossing.

In yet another embodiment, the guidance and hoisting functions are decoupled from each other by introducing guide cables in addition to hoist cables.

DETAILED DESCRIPTION OF THE PREFERRED EMBODIMENT

Figure 1B:
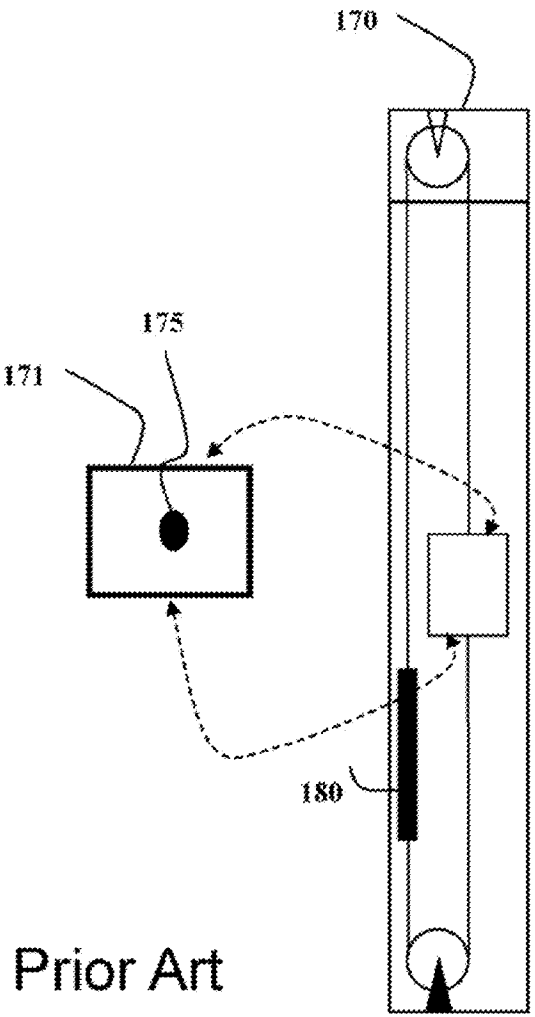
FIG. 1B Prior Art
FIGS. 1A-1B are schematics of a prior art elevator with rail guides.
Figure 1A:
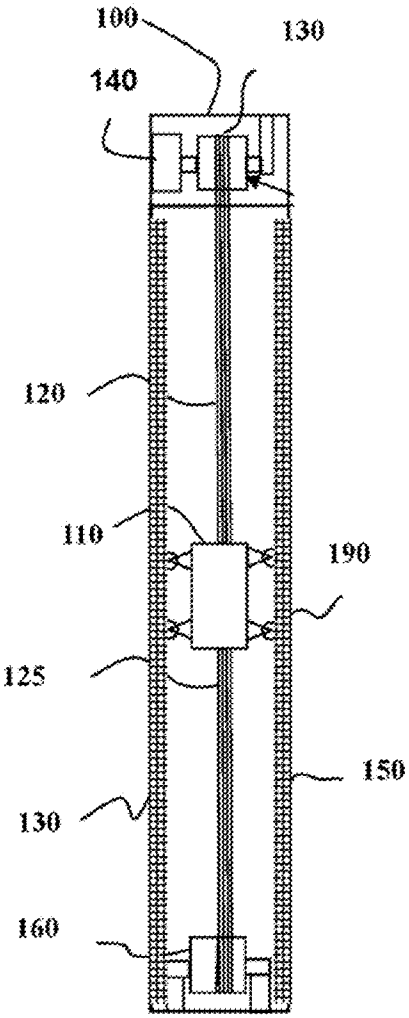
Figure 2B:
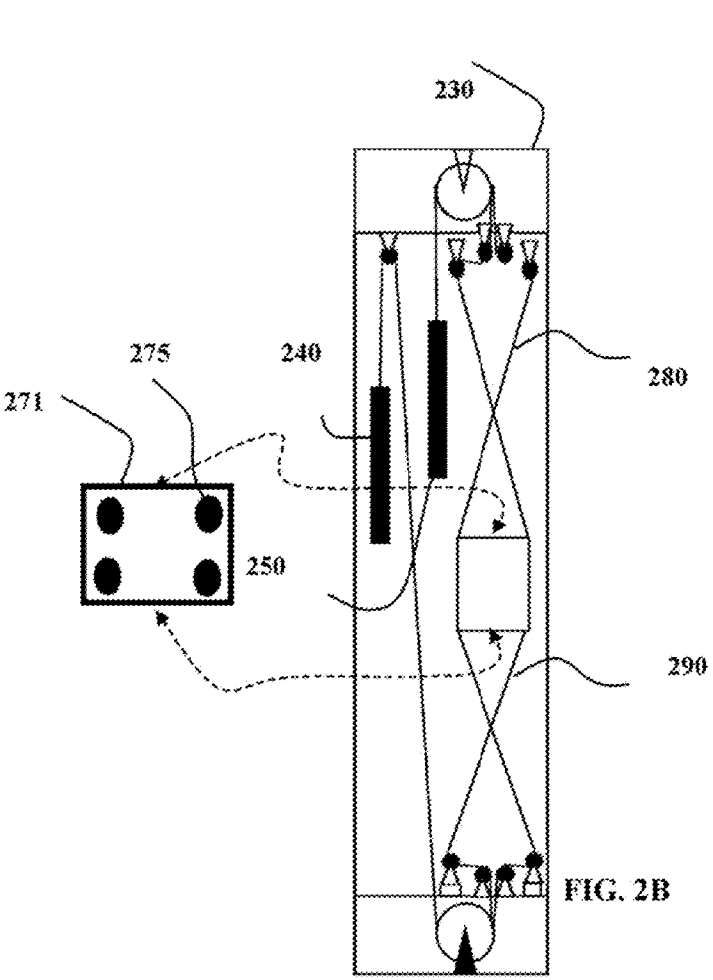
FIGS. 2A-2B are schematics of an elevator according to one embodiment of the invention.
Figure 2A:
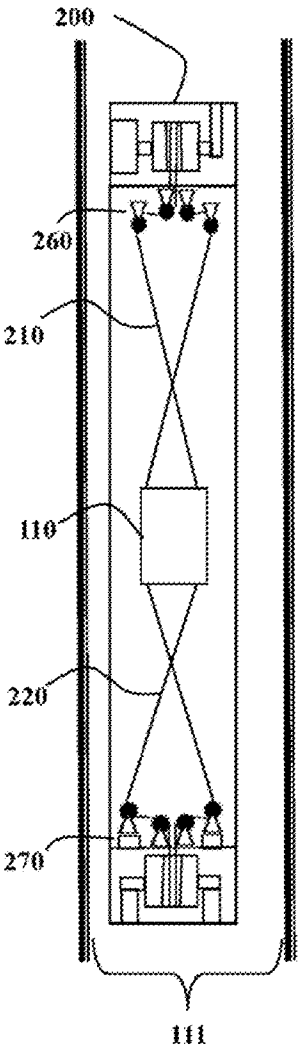

FIGS. 2A-2B show an embodiment of the invention. A car 110 is arranged in a shaft 111. A set of hoist cables 210 driving the car and a set of compensator cables 220 are rearranged in a crisscrossed configuration through pulley arrangements 260 and 270 such that lateral restoring forces (left to right) are always generated from the pretension and inherent longitudinal stiffness of both sets of the cables.

The same crisscross configuration is also used for another set of hoist cables 280 and a set of compensator cables 290 to provide lateral restoring force in orthogonal front, rear and side to side directions.

In addition to lateral (left-right and fore-aft) stiffness, the crisscross configuration also imparts torsional (yaw), and pitch and roll angular stiffness that minimizes parasitic motions in these dimensions for typical loads encountered in daily use, as well as extreme conditions such as earthquake or heavy wind disturbances affecting the building.

In total there are six degrees of freedom possible in the movement of the car, three in rotations and three in translation. The invention constrains the movement to one degree, namely vertically up and down.

In the above described embodiment the cables are at angles with respect to the vertical up/down motion of the car, and lateral motion, as well as rotational motion is constrained. When the cables are at angles that coincide with tangents to a sphere circumscribing the car, pitch and roll rigidity are maximized. In addition, in contrast with conventional cables, the cables according to the embodiments of the invention are displaced from a top and bottom center of the car towards corners 275 of the car to constrain lateral motion, as can be seen in the top view 271.

In other words, the cable configurations limit the motion of the car to a single degree of freedom, that is, vertical motion up and down in the shaft.

Counter weights 240 and 250 are provided, as shown in side view 230, to ensure that the tension in the cables is always maintained without resulting in slack.

More than one cable, usually a bundle of steel cables can be used for each of the hoist cables 210 and 280, and the compensator cables 220 and 290. This embodiment completely eliminates cost for the rail guide and the rail guide installation, and hence, minimizes labor-intensive and costly hoistway preparation and maintenance. Further, the embodiments of the invention eliminate the roller guide assembly and any associated electronics and control system for ensuring ride quality performance in the presence of poor alignment or bumps at the joints of rail guide segments along the shaft of the elevator.

While the simplicity of the embodiment in FIGS. 2A-2B lies in a passive construct, improvements can be added with active means. For example, low power servomotors can be added on top of the car 110, or on extraneous pulleys, such as dancer pulleys and weights, positioned in the shaft for actively controlling tension of hoist cables 210 and 280, or compensator cables 220 and 290, individually.

Figure 3:
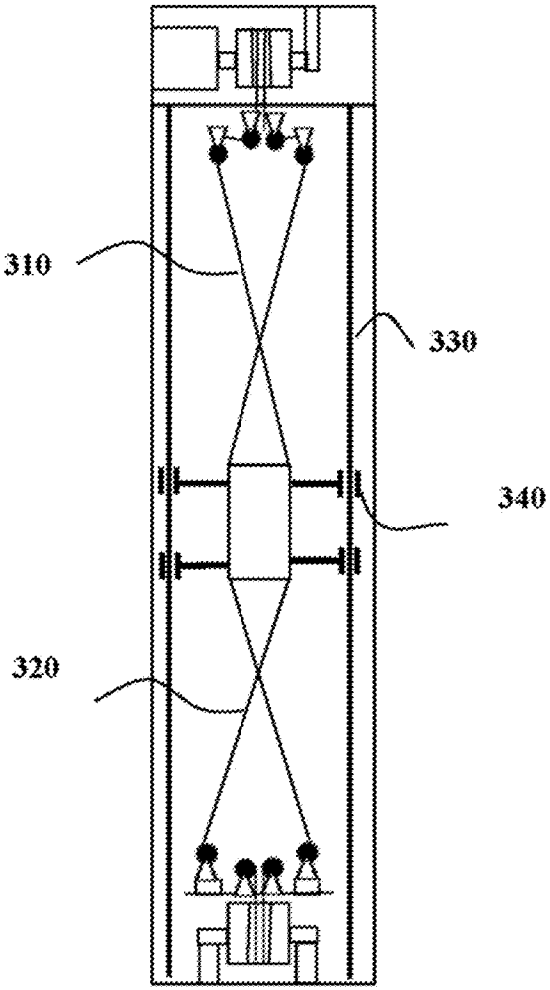
FIG. 3 is a schematic diagram of an elevator with safety cables according to an embodiment of the invention.

FIG. 3 shows another embodiment of the invention with as set of safety cables 330. The crisscrossed hoist cables 310 and compensator cables 320 are the same as indicated in front view 200 of the embodiment of FIG. 2. A gripping mechanism 340 can engage the car with the safety cables 330 to stop the car in case of mechanical failure of the traction motor and hoist drive, or the hoist or compensator cables from excessive loads.

In another embodiment, the safety cables 330 can be anchored at multiple locations in the shaft to enhance lateral rigidity of the car. To ensure safety in extreme cases, redundancy can be imparted to the embodiment of FIG. 3 by using multiple safety cables.

A number of designs for the gripping mechanism 340 are possible, for example a single brake shoe, which comes into contact with the set of cables to achieve distributed braking over a cumulative surface area for generating the braking force.

Figure 4B:
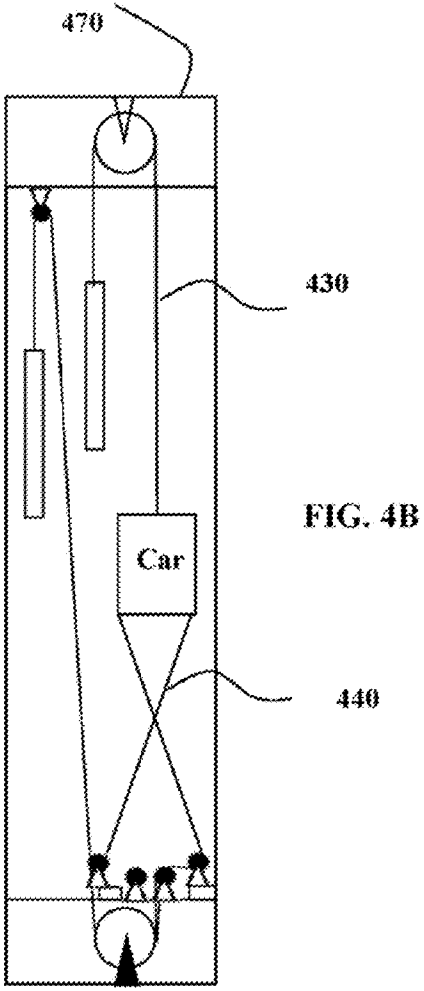
FIGS. 4A-4B are schematics of another embodiment of the invention with crisscross cables in one dimension.
Figure 4A:
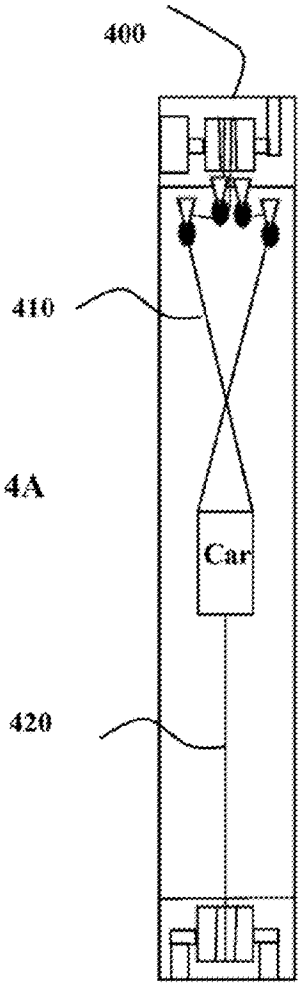

FIGS. 4A-4B show yet another embodiment of the invention in which the crisscross configuration of hoist cables 410 and 430 is used in a left-right direction, as seen in front view 400 but not in the side view 470. Correspondingly, the compensator cables 420 and 440 are in a crisscross configuration in the fore-aft direction, as seen in the side view 470, but not in the front view 400. In other words, the set of hoist cables crisscross in a first vertical plane, and the set of compensator cables crisscross in a second vertical plane orthogonal to the first orthogonal plane to constrain lateral motion of the car. The resulting configuration uses fewer pulleys and cables.

Figure 5B:
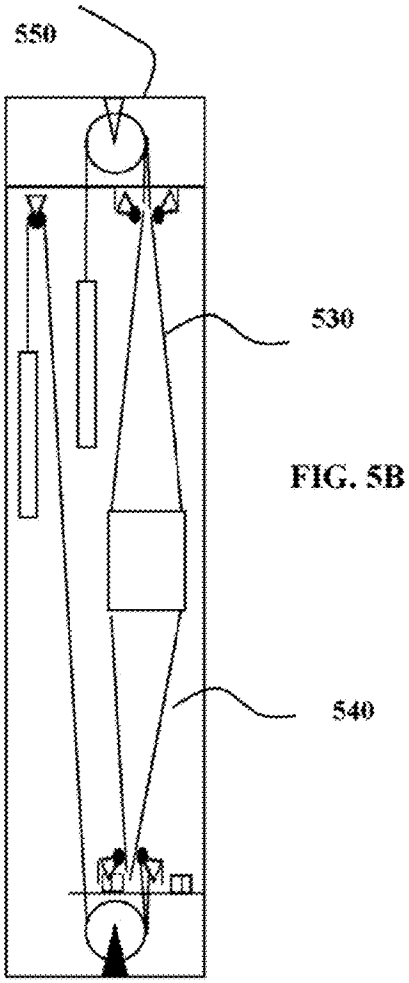
FIGS. 5A-5B are schematics of another embodiment of the invention with pulley arrangements.
Figure 5A:
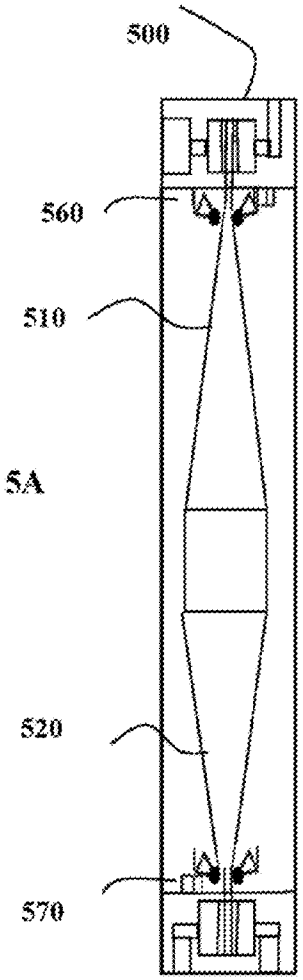

FIGS. 5A-5B show front 500 and side 550 views of yet another embodiment of the invention in which the crisscross configuration is achieved with pulley arrangements 560 and 570, different from the embodiment in embodiments shown in FIGS. 2-4. The configuration includes hoist cables 310 and 33, and compensator cables 520 and 540. With the pulley arrangement of the embodiment in FIGS. 5A-5B, the cables depart in a crisscross configuration at the machine room, itself providing for a larger pivot arm for the parasitic rotation of the car. In comparison with the embodiment of the invention shown in FIG. 2, the embodiment of the invention in FIG. 5 minimizes the number of pulleys. However, this benefit comes at the cost of less torsional (yaw) rigidity, which needs to be compensated for in the design with redundancy in passive manner or using control of tension in an active manner.

Guide Cables

Figure 6:
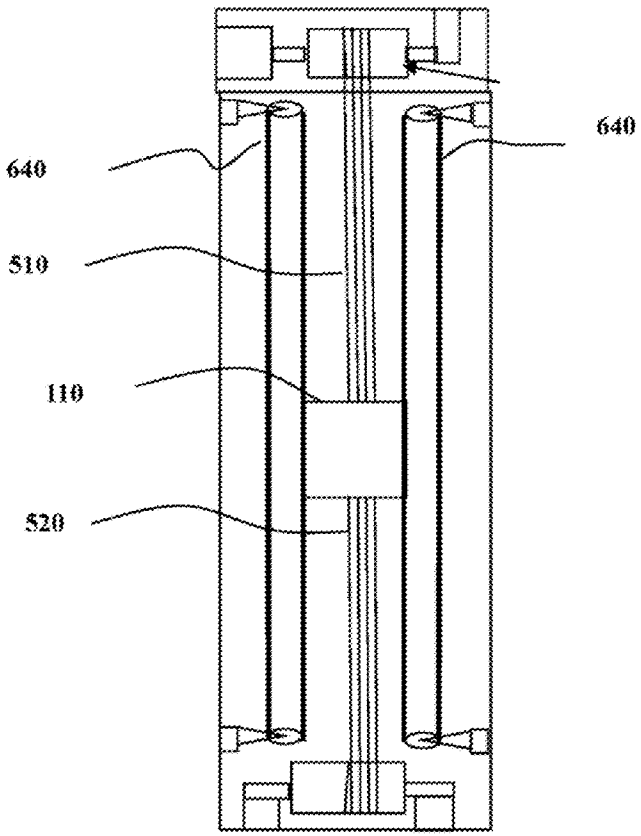
FIG. 6 is a schematic diagram of another embodiment of the invention with guide cables.

FIG. 6. shows yet another embodiment of the invention where the requirements of hoisting and guidance are decoupled. Specifically, guidance for the unconstrained vertical motion is providing as well as constrained lateral motion by the guide cables 640. A crisscross configuration of the same is also possible but care should be taken to ensure that the cables are always in tension without resulting in slack.

Flat Cables

Figure 7:
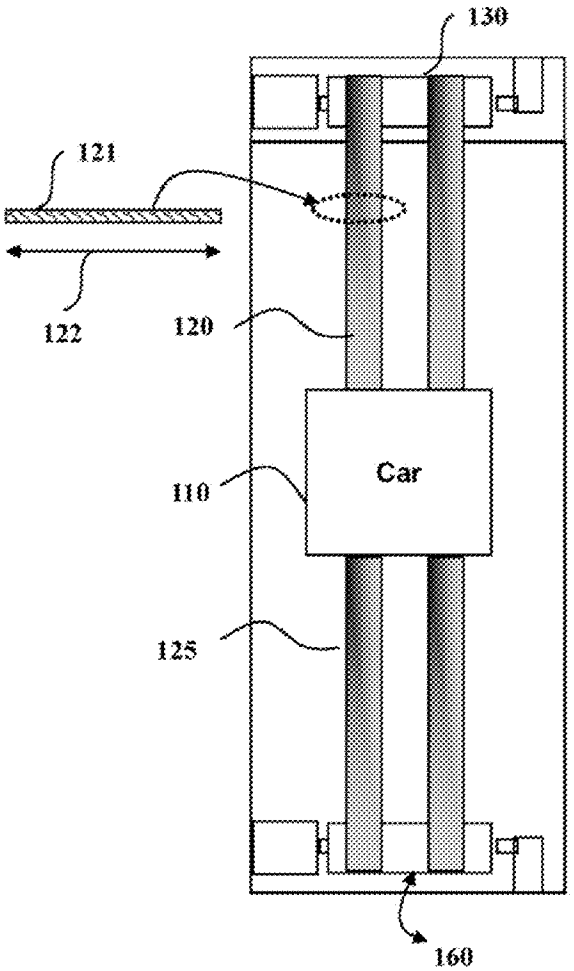
FIG. 7 is a schematic diagram of an elevator with flat cables according to an embodiment of the invention.

FIG. 7 shows another embodiment. Here, a cross section 121 of the hoist and compensator cables is rectangular (flat), and made of a material that is substantially rigid along a longitudinal axis of the cable. For example, the cables are made of elongated thin sheets of rollable steel.

The sheets can be designed for geometry and appropriate material selection to allow for compliant motion in one direction but rigidity in all other directions, while ensuring structural stability and increasing resistance to tear. A suitable configuration of sheets of steel can be placed around the shaft to achieve adequate lateral, torsional, and pitch/roll angular rigidity. These advantages are possible with this embodiment, while at the same time offering the advantage of rollability, which significantly reduces the cost of transportation of raw material steel sheets, as well as installation when compared to conventional rail guides.

Motion Model

Figure 8:
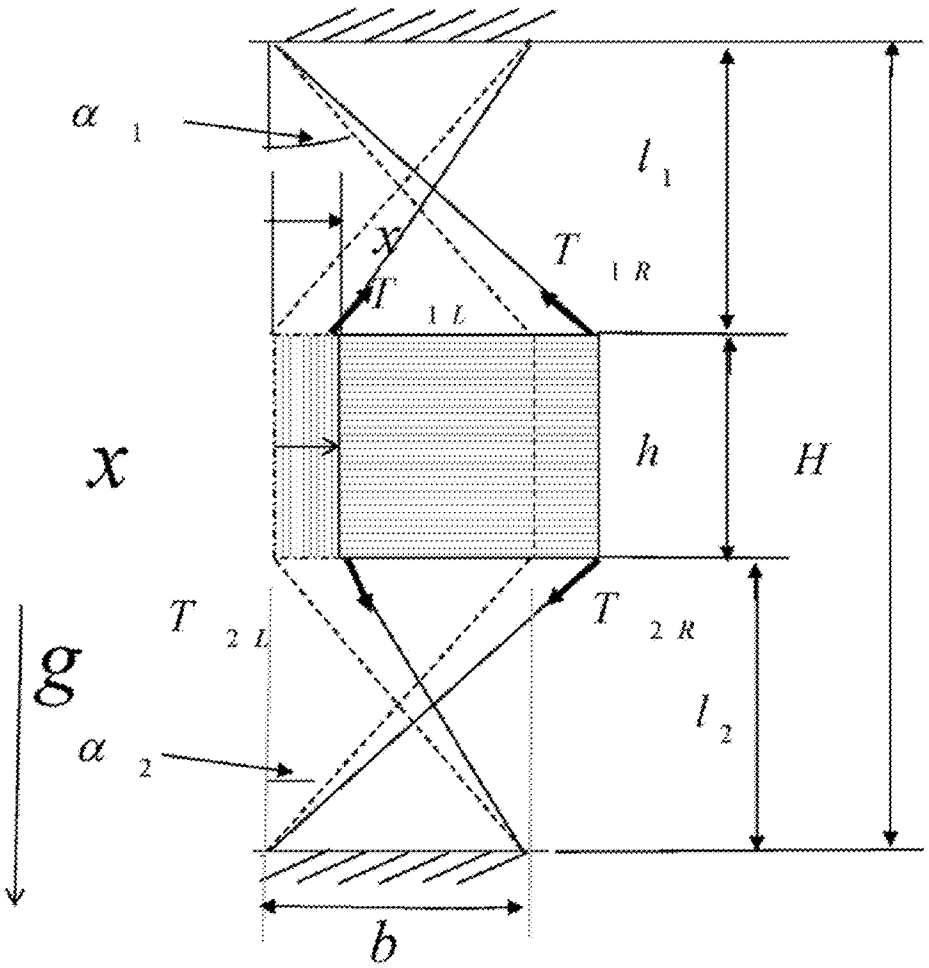
FIG. 8 is a schematic diagram of a free body diagram depicting an underlying physical model for an embodiment of the invention.

FIG. 8 shows one of the many ways to model the embodiment of the invention shown in FIG. 2. To describe the benefits of improved lateral rigidity with a crisscross configuration, in this model, the assumptions are made for elevator as being a rigid body, and the cables as being subject to non-negligible axial stretch, constant pretension, uniform axial stiffness, and uniform physical damping.

The equations of motion of the car in the lateral direction for small displacements x are as follows:

$$m\ddot{x}=-T_{1R}\sin\alpha_{1R}+T_{1L}\sin\alpha_{1L}-T_{2R}\sin\alpha_{2R}+T_{2L}\sin\alpha_{2L}$$

$$T_{1R}=T_{10}+k_1(\sqrt{l_1^2+(b+x)^2}-\sqrt{l_1^2+b^2})$$

$$T_{1L}=T_{10}+k_1(\sqrt{l_1^2+(b-x)^2}-\sqrt{l_1^2+b^2})$$

$$T_{2R}=T_{20}+k_2(\sqrt{l_2^2+(b+x)^2}-\sqrt{l_2^2+b^2})$$

$$T_{2L}=T_{20}+k_2(\sqrt{l_2^2+(b-x)^2}-\sqrt{l_2^2+b^2})$$

where the variables are as shown and defined in the FIG. 7 below, and $k_1$ and $k_2$ denote the longitudinal stiffness of the cables, and are given as EA/length of the cable, $T_{10}$ and $T_{20}$ are pretension in the cables.

Under small angle assumption, we have $$T_{1R}\approx T_{10}+(k_1\sin\alpha_1)x \quad \sin\alpha_{1R}=\frac{b+x}{L_1};\quad \sin\alpha_{1L}=\frac{b-x}{L_1}$$

$$T_{1L}\approx T_{10}-(k_1\sin\alpha_1)x$$

$$T_{2R}\approx T_{20}+(k_2\sin\alpha_2)x \quad \sin\alpha_{2R}=\frac{b+x}{L_2};\quad \sin\alpha_{2L}=\frac{b-x}{L_2}$$

$$T_{2L}\approx T_{20}-(k_2\sin\alpha_2)x$$

The above equation of motion can be simplified to:

$$m\ddot{x}=-n\left[\frac{mg}{L_1\cos\alpha_1}+T_{20}\left(\frac{2}{L_2}+\frac{2}{L_1}\frac{\cos\alpha_2}{\cos\alpha_1}\right)+2k_1\sin^2\alpha_1+2k_2\sin^2\alpha_2\right]x+F_x$$

resulting in a lateral stiffness:

$$K_x=n\left[\frac{mg}{L\cos\alpha}+T_{20}\left(\frac{2}{L}+\frac{2}{L}\right)+4k\sin^2\alpha\right]$$

and torsional stiffness:

$$K_t=4k\left(\frac{b}{L}\left(\frac{l+h}{2}\right)^2\right)$$

A typical design problem can be solved using the above equations as follows. Consider a building of height 25 m, and an elevator car of moving mass 8000N and dimensions: height h=3.2 m, width b=3.5 m length a=3.5 m.

For a maximum lateral force of 4375 N generated from passenger loading the elevator, two cables for both hoist and compensator cables made of Drako 300T (round strand equal lay) ropes with diameter 16 mm, Young's modulus 70 GPa, breaking load 143 kN suffice to generate a lateral displacement of less than 10 mm, which is less than the gap between the car and the shaft. For a maximum disturbance torque of 14000 Nm, the pitch/roll angular displacement is 0.035°, which is small and unnoticeable by passengers. Velocity and acceleration profiles of the car and earthquake or wind disturbances can be incorporated into the model to show that the lateral and angular displacements are still met throughout the traversal of the car in a 25 m length of the shaft.

Although the invention has been described by way of examples of preferred embodiments, it is to be understood that various other adaptations and modifications can he made within the spirit and scope of the invention. Therefore, it is the object of the appended claims to cover all such variations and modifications as come within the true spirit and scope of the invention.

We claim:

1. An elevator, comprising:

an elevator car for riding passengers of the elevator in an elevator shaft;

a set of compensator cables attached to a bottom of the elevator car and engaged with a compensator drum, wherein the compensator cables crisscross each other generating lateral restoring forces from pretension and longitudinal stiffness of the compensator cables;

a set of hoist cables attached to a top of the elevator car and engaged with a hoist drum to move the elevator car vertically in the elevator shaft, wherein the hoist cables crisscross each other to generate lateral restoring forces from pretension and longitudinal stiffness of the hoist cables;

at least one counterweight connected to the hoist cables to maintain the pretension of the hoist cables, such that the set of compensator cables and the set of hoist cables restore forces and torques, and impart torsional, pitch and roll angular stiffness that minimize parasitic motions of the elevator car.

2. The elevator of claim 1, wherein the lateral restoring forces are in orthogonal front, rear and side to side directions of the elevator car.

3. The elevator of claim 1, wherein the elevator car has six degrees of freedom, and the set of compensator cables and the set of hoist cables constrain the elevator car to one degree of freedom in up and down directions.

4. The elevator of claim 1, wherein the set of compensator cables and the set of hoist cables are at angles with respect to vertical up and down motion of the elevator car, while lateral motions and rotational motions are constrained.

5. The elevator of claim 1, wherein the set of compensator cables and the set of hoist cables are displaced from a top and bottom center of the elevator car towards corners of the car to constrain lateral motion.

6. The elevator of claim 1, wherein the set of hoist cables crisscross in a first vertical plane, and the set of compensator cables crisscross in a second vertical plane orthogonal to the first orthogonal plane to constrain lateral motion of the elevator car.

7. The elevator of claim 1, wherein the set of compensator cables and the set of hoist cables completely eliminate rail guides in the shaft.

8. The elevator of claim 1, further comprising:

a set of power servomotors, dancer pulleys, and weights for actively controlling tension of the set of compensator cables and the set of hoist cables.

9. The elevator of claim 8, wherein the safety cables are anchored at multiple locations in the shaft to enhance lateral rigidity of the car.

10. The elevator of claim 1, further comprising a set of safety cables arranged in the shaft; and a gripping mechanism configured to engage the car with the safety cables.

11. A method for moving an elevator car arranged for riding passengers in an elevator shaft of an elevator, comprising:

attaching a set of compensator cables to a bottom of the elevator car and a compensator drum, such that the compensator cables crisscross each other generating lateral restoring forces from pretension and longitudinal stiffness of the compensator cables;

attaching a set of hoist cables to a top of the elevator car and a hoist drum, such that the hoist cables crisscross each other to generate lateral restoring forces from pretension and longitudinal stiffness of the hoist cables;

connecting to the hoist cables to at least one counterweight to maintain the pretension of the hoist cables during the moving; and constraining the elevator car to move only vertically in the elevator shaft using the lateral restoring forces generated from pretension and longitudinal stiffness of the compensator and hoist cables.

* * * * *